US009196993B2

(12) United States Patent
Sato et al.

(10) Patent No.: US 9,196,993 B2
(45) Date of Patent: Nov. 24, 2015

(54) CONNECTOR UNIT

(71) Applicant: Yazaki Corporation, Tokyo (JP)

(72) Inventors: Akira Sato, Makinohara (JP); Kazuhide Takahashi, Makinohara (JP); Kenji Takahashi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/206,243

(22) Filed: Mar. 12, 2014

(65) Prior Publication Data

US 2014/0194013 A1 Jul. 10, 2014

Related U.S. Application Data

(63) Continuation of application No. PCT/JP2012/005735, filed on Sep. 11, 2012.

(30) Foreign Application Priority Data

Sep. 13, 2011 (JP) ..... 2011-199071

(51) Int. Cl.

| | |
|---|---|
| ***H01R 13/424*** | (2006.01) |
| ***H01R 13/436*** | (2006.01) |
| ***H01R 13/64*** | (2006.01) |
| *H01R 107/00* | (2006.01) |

(52) U.S. Cl.

CPC ..... *H01R 13/424* (2013.01); *H01R 13/4362* (2013.01); *H01R 13/64* (2013.01); *H01R 2107/00* (2013.01); *H01R 2201/26* (2013.01)

(58) Field of Classification Search

CPC ..... H01R 13/4362; H01R 13/64; H01R 2107/00; H01R 2201/26; H01R 13/424

USPC ..... 439/744, 595, 752, 347, 350–358, 439/137–141

See application file for complete search history.

(56) References Cited

U.S. PATENT DOCUMENTS

| | | | | |
|---|---|---|---|---|
| 5,609,503 | A | 3/1997 | Tsuji et al. | |
| 6,648,699 | B1 * | 11/2003 | Makino et al. | 439/752 |
| 6,824,417 | B1 * | 11/2004 | Nimura | 439/352 |
| 7,377,824 | B2 * | 5/2008 | Mizutani et al. | 439/752 |
| 2005/0042921 | A1 | 2/2005 | Nakamura | |

FOREIGN PATENT DOCUMENTS

JP 07-326419 A 12/1995

OTHER PUBLICATIONS

International Search Report and Written Opinion dated Nov. 20, 2012, issued for PCT/JP2012/005735.

* cited by examiner

*Primary Examiner* — Edwin A. Leon

(74) *Attorney, Agent, or Firm* — Locke Lord LLP

(57) ABSTRACT

A first connector housing of a first connector includes a fitting concave having an inner wall portion extended in a fitting direction X and formed in substantially a circular shape, and the inner wall portion has a first step portion extended perpendicular to the fitting direction X and projected inward. A second connector housing of a second connector includes a fitting convex having an outer wall portion extended in the fitting direction X and formed in substantially a columnar shape, and the outer wall portion has a second step portion indented inward corresponding to the first step portion. A spacer is projected from at least two positions of a part of the outer wall portion and the second step portion in a temporary locking position, and is sunken in the outer wall portion or arranged in the same plane as the outer wall portion in a regular locking position.

3 Claims, 5 Drawing Sheets

CONNECTOR UNIT

TECHNICAL FIELD

This invention relates to a connector unit as a component of a wiring harness routed in a vehicle or the like, and able to be fitted together for connecting the wiring harnesses to each other, or connecting the wiring harness to electronic devices.

BACKGROUND ART

Various electronic devices are mounted on a vehicle or the like, and a wiring harness is routed for supplying electric power, control signal, and the like to the electronic devices. The wiring harness includes: a plurality of electric wires; and a connector, and by fitting the connector to a connector of the electronic devices or a connector of the other wiring harness, the wiring harness is connected to the electronic devices or the other wiring harness.

A typical connector used in such a wiring harness includes: a connector housing; and a terminal received in the connector housing and attached to an end of the electric wire. Various connectors are used according to usage environment and intended use. Further, as a connector, there are a so-called male connector receiving a bar-shaped male terminal, and a so-called female connector receiving a tubular female terminal. These male and female connectors are mechanically and electrically connected to each other by fitting the male and female terminals to each other and by inserting the male terminal into the female terminal.

Further, the connector housing includes: a straight-hole-shaped terminal receiving chamber for receiving the terminal; and a locking lance projected in the terminal receiving chamber and provided elastically deformable for locking the terminal in the terminal receiving chamber. In such a connector, because a short of the locking power by only locking the terminal with the locking lance, the terminal may fall out of the connector housing when the wiring harness is routed around in a production process. For this reason, a connector having a spacer is proposed (for example, see PTL 1) to regularly lock to prevent the terminal from moving so as to prevent the terminal from falling out of the housing in addition to a lock with the locking lance.

As shown in FIGS. 5 to 9, a connector 100 described in PTL 1 is a so-called female connector including: a connector housing 101; a spacer 102; and a female terminal connected to an electric wire W. As shown in FIGS. 7 and 9, this connector 100 is fitted to a mating connector 110 as a so-called male connector including: a connector housing 111; and a mate terminal 112, and mechanically and electrically connected to each other. The connector housing 101 is made of insulating synthetic resin, formed in a box shape as a whole, and includes: a terminal receiving chamber 104 for receiving a female terminal 103; and a spacer receiving chamber 105 for receiving a spacer 102.

A plurality of terminal receiving chambers 104 are provided up and down, left and right parallel to each other, and respectively extended straight. Both ends in a longitudinal direction of the terminal, receiving chamber 104 are open on an end face of the connector housing 101. The female terminal 103 is inserted into the terminal receiving chamber 104 along its longitudinal direction (insertion direction of the terminal), and a locking lance 106 is formed in the terminal receiving chamber 104 at a rear side in the insertion direction. The spacer receiving chamber 105 is formed in a concave shape on one outer wall perpendicular to the longitudinal direction of the terminal receiving chamber 104 among a plurality of outer walls of the connector housing 101, and provided crossing the substantially center in the longitudinal direction of the terminal receiving chamber 104.

The spacer 102 is made of insulating synthetic resin or the like, and includes: a spacer main body 107*l*; and an insertion portion 108 to be inserted into the spacer receiving chamber 105. A regulation portion 107A for preventing the female terminal 103 from falling out by positioning in the upper terminal receiving chamber 104 is formed in the spacer main body 107. An opening 108 through which the female terminal 103 is inserted and a regulation portion 108A for preventing the female terminal 103 from falling out by positioning the lower terminal receiving chamber 104 are formed in the insertion portion 108. As shown in FIGS. 6 and 7, when the spacer 102 is inserted into the spacer receiving chamber 105, firstly, a projection 108C of the insertion portion 108 is locked with the connector housing 101 and positioned in a temporary locking position.

While the spacer 102 is positioned in the temporary locking position, the opening 108A of the insertion portion 108 and the upper terminal receiving chamber 104 are communicated with each other, and a lower space of the insertion portion 108 and the lower terminal receiving chamber 104 are communicated with each other, thereby the female terminal 103 is allowed to be inserted into the terminal receiving chamber 104. Then, when the female terminal 103 is inserted into the terminal receiving chamber 104, the locking lance 106 is elastically deformed to lock a concave at a tip of the female terminal 103, in this temporary locking condition of the female terminal 103, when the locking lance 106 is elastically deformed by an extraction jig or the like, the lock with the locking lance 106 is released, and the female terminal 103 is allowed to be pulled out from the connector housing 101.

Then, as shown in FIGS. 8 and 9, when the spacer 102 positioned in the temporary locking position is further inserted into the spacer receiving chamber 105, the projection 108C of the insertion portion 108 is locked with a concave in the connector housing 101, and positioned in a regular locking position. When the spacer 102 is positioned in the regular locking position, the regulation portion 107A of the spacer main body 107 is projected in the upper terminal receiving chamber 104, and the regulation portion 108B of the insertion portion 108 is projected in the lower terminal receiving chamber 104, thereby the regulation portions 107A, 108B locks a rear end of the female terminal 103. In this way, the spacer 102 positioned in the regular locking position prevents the female terminal 103 from falling out of the connector housing 101.

According to the above connector 100 having a spacer, as shown in FIGS. 6 and 7, when the spacer 102 is positioned in the temporary locking position, the spacer main body 107 is projected from an upper wall of the connector housing 101, thereby a mating connector 110 cannot be fitted to the connector 100 because the mating connector 110 is abutted on the spacer main body 107. Thus, because the connector 100 and the mating connector 110 cannot be fitted to each other, a middle insertion state of the spacer 102 in which the spacer 102 is in the temporary locking position, and not inserted to the regular locking position can be detected. In contrast, as shown in FIGS. 8 and 9, when the spacer 102 is inserted to the regular locking position, the spacer main body 107 is not projected from the connector housing 101, thereby the connector 100 and the mating connector 110 can be fitted to each other to be mechanically and electrically connected to each other.

CITATION LIST

Patent Literature

[PTL 1]
JP, A, H07-326419

SUMMARY OF INVENTION

Technical Problem

However, in the conventional connector disclosed in PTL 1, for smoothly fitting to the mating connector, generally, a specific clearance is provided in a fitting portion of both connector housings. Therefore, even when the spacer is in the middle insertion condition and not in the regular locking position, the connectors may be fitted to each other when the projection length of the spacer is smaller than the clearance, or when the connector is obliquely pushed in the fitting direction. Thus, when the connectors are fitted to each other while the spacer is in the middle insertion condition, the locking force of the terminal becomes insufficient, and the terminal may fall out of the connector housing when the wiring harness is routed around.

According to the above, an object of the present invention is to provide a connector unit able to prevent a terminal from falling out of a connector housing by securing a lock of the terminal with a spacer.

Solution to Problem

For attaining the object, according to a first aspect of the present invention, there is provided a connector unit including:

a first connector having a first connector housing receiving a first terminal; and a second connector having a second connector housing receiving a second terminal, said first and second connectors being fitted to each other by facing each other and pressing in a fitting direction, wherein the second connector includes a spacer provided movably in between a temporary locking position where the second terminal is allowed to fall out of the second connector housing and a regular locking position where the second terminal is prevented from falling out of the second connector housing, wherein the first connector housing includes a fitting concave having an inner wall portion extended in the fitting direction and formed in substantially a circular shape, and the inner wall portion has a first step portion extended perpendicular to the fitting direction and projected inward, wherein the second connector housing includes a fitting convex having an outer wall portion extended in the fitting direction and formed in substantially a columnar shape, and the outer wall portion has a second step portion indented inward corresponding to the first step portion, and wherein the spacer is projected from at least two positions of a part of the outer wall portion and the second step portion of the fitting convex in the temporary locking position, and is sunken in the outer wall portion or arranged in the same plane as the outer wall portion in the regular locking position.

According to the above, when the first and second connectors are fitted to each other by inserting the fitting convex of the second connector housing into the fitting convex of the first, housing, the outer wall portion of the fitting convex is moved along the inner wall portion of the fitting concave, and the second step portion is moved along the first step portion. At this time, when the spacer is positioned in the temporary locking position, because the spacer is projected from at least two positions of a part of the outer wall portion and the second step portion of the fitting convex, there is a possibility that there at least two projections may be abutted on the fitting concave, and it becomes easy to detect that the spacer is not inserted to the regular locking position and in a middle insertion condition. Namely, even when the projection length of the spacer is smaller than the clearance between the inner wall portion of the fitting concave and the outer wall portion of the fitting convex, because at least two different projections of the spacer are projected, any one of the two projections may be easily abutted on the fitting convex, thereby detection accuracy of the middle insertion condition is improved.

According to a second aspect of the present invention, there is provided the connector unit as described in the first aspect, wherein one of the first step portion of the fitting concave and the second step portion of the fitting convex is provided with a guiding groove extended in the fitting direction, and the other is provided with a projection to be inserted into the guiding groove.

According to the above, because the projection is guided along the guiding groove, a rotation or an inclination of the fitting convex or the fitting concave is prevented when the fitting convex is inserted into the fitting convex, and the fitting convex can be inserted straight into the fitting concave along the fitting direction. Further, because one of the first and second step portions is provided with the guiding groove, and the other is provided with the projection, position accuracy of the first and second step portions when inserting is improved.

According to a third aspect of the present invention, there is provided the connector unit as described in the first or second aspect, wherein the inner wall portion of the fitting concave includes: a first inner wall along a first crossing direction of the first and a second crossing directions perpendicular to the fitting direction and crossing to each other; a second inner wall along the second crossing direction; a first sub inner wall crossing to the first inner wall and extended to an inside of the fitting concave; and a second sub inner wall crossing the second inner wall, extended to the inside of the fitting concave and continued to the first sub inner wall, and the first and second sub inner walls compose the first step portion, wherein the outer wall portion of the fitting convex includes: while fitted to the fitting concave, a first outer wall adjacent and facing to the first inner wall; a second outer wall adjacent and facing to the second inner wall; a first sub outer wall adjacent and facing to the first sub inner wall: and a second sub outer wall adjacent and facing to the second sub inner wall, and the first and second sub outer walls compose the second step portion, and wherein the spacer in the temporary locking position is provided projectably from the first outer wall and the second sub outer wall.

According to the above, the first step portion bent in a crank shape and projected inward is composed of the first inner wall, the second inner wall, the first sub inner wall, and the second sub inner wall in the inner wall portion of the fitting concave, and the second step portion bent in a crank shape and indented inward is composed of the first outer wall, the second outer wall, the first sub outer wall, and the second sub outer wall in the outer wall portion of the fitting convex. While the projected first step portion and the indented second step portion are moved along each other, when the fitting convex is inserted into the fitting concave, position accuracy upon insertion is improved. Further, because the first outer wall and the second sub outer wall of the fitting convex are provided away from each other via the first sub outer wall, when the spacer is projected from the first outer wall and the second sub outer the detection accuracy of the middle insertion condition of the spacer is further improved.

According to a fourth aspect of the present invention, there is provided the connector unit as described in the third aspects, wherein in the inner wall portion of the fitting concave, a pair of the second inner walls facing to each other is provided, a pair of the first sub inner walls continued to both ends of the first inner wall is provided, a pair of the second sub inner walls extended to the pair of the first sub inner walls and the pair of second inner walls is provided, and in the outer wall portion of the fitting convex, a pair of the second outer walls respectively corresponding to the pair of the second inner walls is provided, a pair of the first sub outer walls respectively corresponding to the pair of the first sub inner walls is provided, and a pair of the second sub outer walls respectively corresponding to the pair of the second sub inner walls is provided.

According to the above, in the inner wall portion of the fitting concave, a pair of the second inner walls, a pair of the first sub inner walls, and a pair of the second sub inner walls are provided respectively sandwiching the first inner wall. Therefore, the left and right symmetrical first step portion is formed. Similarly, in the outer wall portion of the fitting convex, the left and right symmetrical second step portion is formed. Therefore, the spacer positioned in the temporary locking position is projected from left and right of the second step portion, and abutment between these projections of the spacer and the left and right of the first step portion is further easily detected.

Advantageous Effects of Invention

According to the invention as described in the first aspect, the spacer is projectable from two positions different from each other in the outer wall portion of the fitting convex. Therefore, the projected spacer becomes easy to be abutted on the fitting concave, and the middle insertion condition is easily detected. Therefore, when the detected spacer in the middle insertion condition is inserted again to the regular locking position, the first and second connectors are prevented from being fitted to each other while the spacer is in the middle insertion condition. Further, the spacer inserted again to the regular locking position surely prevents the terminal from being moved. Therefore, the terminal is prevented from falling out of the second connector housing.

According to the invention as described in the second aspect, the projection is guided along the guiding groove in between the first and second step portions, and the first and second step portions are inserted to specific positions relative to each other. Therefore, when the spacer is in the middle insertion condition, the spacer projected from the second step portion becomes easy to be abutted on the first step portion, and this abutment is detected with high accuracy.

According to the invention as described in the third aspect, accuracy of a relative position between the first and second steps is increased, and the projections of the spacer projected from at least two positions are provided away from each other. Therefore, detection accuracy when the spacer is in the middle insertion condition is improved.

According to the invention as described in the fourth aspect, the second step portion is provided left and right sandwiching the first outer wall. Therefore, the spacer in the middle insertion condition is projected from at least three positions of the first outer wall, the second sub outer wall of the left and right pair of second step portion. These projections of the spacer become easy to be abutted on the inner wall portion of the fitting concave, and the detection accuracy of the middle insertion condition is father improved.

DESCRIPTION OF EMBODIMENTS

Hereinafter, a connector unit according to an embodiment of the present invention will be explained with reference to FIGS. 1 to 4. The connector unit of this embodiment is composed of a pair of a male connector 1 as a first connector shown in FIG. 1 and a female connector 2 as a second connector shown in FIG. 2. These male and female connectors 1, 2 are provided on a wiring harness routed in a vehicle or the like, or on electronic devices or the like. When the male and female connectors 1, 2 are fitted to each other, the wiring harness and the wiring harness, or the wiring harness and the electronic device are electrically connected to each other. Incidentally, in the followings, a fitting direction of the male and female connectors 1, 2 is referred to as a connector fitting direction X. Further, two directions perpendicular to each other in a plane perpendicular to the fitting direction X are respectively referred to as a first crossing direction Y and a second crossing direction Z, and are denoted by arrows Y, Z in drawings.

Figure 1:
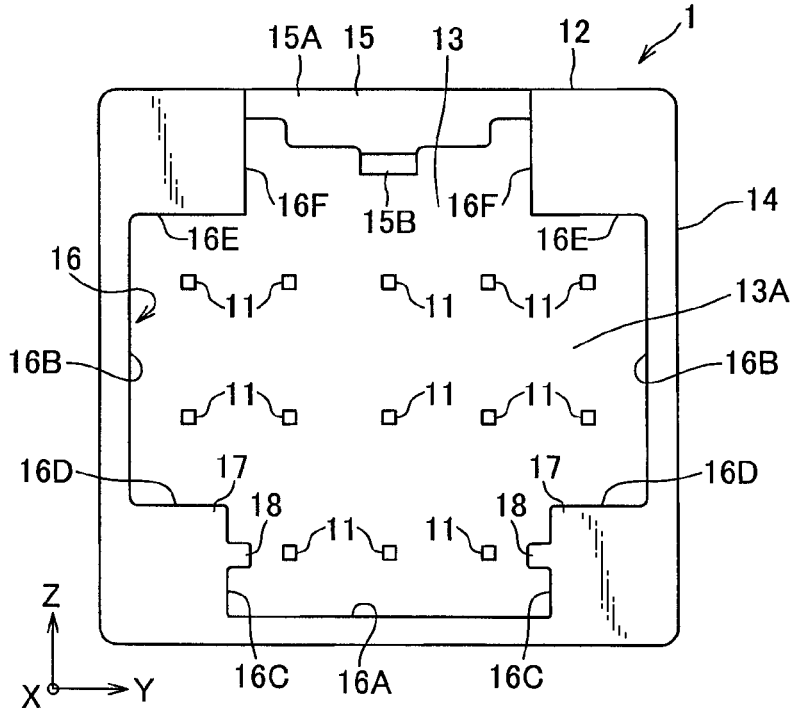
FIG. 1 is a front view showing a first connector of a connector unit according to an embodiment of the present invention.

As shown in FIG. 1, the male connector 1 includes: a plurality of male terminals 11 as first terminals; and a connector housing (first connector housing) 12 receiving the male terminals 11. The male terminal 11 is made by punching and folding a conductive metal plate, and its tip is formed in a bar shape. This tip is projected from the connector housing 12 toward a front side of a paper in FIG. 1. Further, a not-shown core wire of an electric wire is crimped at a rear end of the male terminal 11. This electric wire is extended outward (rear side of a paper of FIG. 1) from the connector housing 12.

The connector housing 12 is made of insulating synthetic resin or the like, and includes: a box-shaped housing main body 13 receiving male terminals 11; a fitting concave 14 provided at a front side of the housing main body 13; and an engaging portion 15 to be engaged with the female connector 2. The housing main body 13 is provided with a not-shown terminal receiving chamber for receiving the male terminal 11. The tip of the male terminal 11 penetrating a front wall 13A of the housing main body 13 is positioned in the fitting concave 14.

The fitting concave 14 is formed in substantially a rectangular shape as a whole, in a circular shape of which the engaging portion 15 is notched, and in a concave sectional shape opening at a front side (front side of a paper of FIG. 1) and having the front wall 13A as a bottom wall. This fitting concave 14 includes an inner wall portion 16 extended in the fitting direction X. The inner wall portion 16 includes: a first inner wall 16A opposite to the engaging portion 15 and extended in the first crossing direction Y; a pair of second inner walls 16B facing each other left and right and extended in the second crossing direction Z; a pair of first sub inner walls 16C extended upward in the second crossing direction Z from both ends of the first inner wall 16A; a pair of second sub inner walls 16D respectively extended in the first crossing direction Y from one ends of the second inner walls 16B and continued to the first sub inner walls 16C; and a pair of third inner walls 16E respectively extended in the first crossing direction Y from the other ends of the second inner walls 16B.

A pair of first step portions 17 composed of the first sub inner walls 16C and the second sub inner walls 16D and crossing the fitting direction X, and projected inward of the fitting concave 14 is formed in the inner wall portion 16 of the fitting concave 14. Further, a pair of projections 18 projected from a pair of the first sub inner walls 16C in the first crossing direction Y, and extended in the fitting direction X is formed in the inner wall portion 16. Further, a fourth inner wall 16F extended outward in the second crossing direction Z is continued to an end of the third inner wall, and the engaging portion 15 is held between a pair of the fourth inner walls 16F facing each other. The engaging portion 15 includes: a beam 15A provided between the fourth inner walls 16F; and an engaging projection 15B projected inward of the fitting concave 14 from substantially the center of the beam 15A crossing the fitting direction X.

Figure 2:
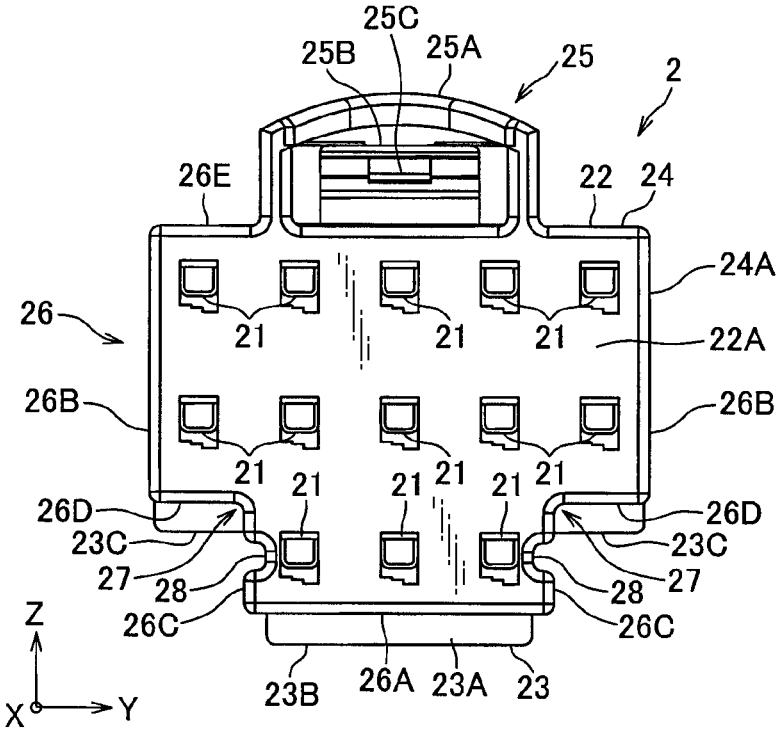
FIG. 2 is a front view showing a second connector of the connector unit.

As shown in FIG. 2, the female connector 2 includes: a plurality of female terminals 21 as second terminals; a connector housing (second connector housing) 22 receiving the female terminals 21; and a spacer 23 inserted into the connector housing 22. The female terminal 21 is made by punching and folding a conductive metal plate, and formed with a square-tubular electric contact portion and a wire connecting portion at a rear side thereof. The electric contact portion of the female terminal 21 is exposed outside via a through-hole provided on a front wall 22A of the connector housing 22, and the male terminal 11 is allowed to be inserted into the electric contact from a front side. Further, a core wire of a not-shown electric wire is crimped onto the wire connecting portion of the female terminal 21, and this electric wire is extended outside (rear side of a paper in FIG. 2) of the connector housing 22.

The connector housing 22 is made of insulating synthetic resin or the like, and includes: a box-shaped housing main body 24 receiving the plurality of female terminals 21; and a locking portion 25 for engaging with the engaging portion 15 of the male connector 1. The housing main body 24 includes: a not-shown terminal receiving chamber receiving the female terminal 21; and a not-shown spacer receiving chamber receiving the spacer 23. The terminal receiving chamber is provided with a not-shown locking lance locking the female terminal 21 inserted from a rear side of the housing main body 24. The spacer receiving chamber is opened at an opposite side of the locking portion 25 crossing the fitting direction X, and allows the spacer 23 to be locked at two positions of a temporally locking position (position shown in FIG. 2) and a regular locking position.

The housing main body 24 is formed in a convex octagonal column shape in front view, and includes an outer wall portion 26 as a peripheral wall extended in the fitting direction X. A front side of the housing main body 24 is a fitting convex 24A to be inserted into and fitted to the fitting concave 14 of the male connector 1. The outer wall portion 26 includes: a first outer wall 26A opposite to the locking portion 25 and extended in the first crossing direction Y; a pair of second outer walls 26B extended in the second crossing direction Z at left, and right side of FIG. 2; a pair of first sub outer walls 26C extended upward in the second crossing direction Z from both ends of the first outer wall 26A; a pair of second sub outer walls 26D respectively extended inward in the first crossing direction Y from ends of the second outer walls 26B and continued to the first sub outer walls 26C and a third outer wall 26E extended in the first crossing direction Y from the other ends of the second outer wall 26B.

A pair of second step portions 27 composed of the first sub outer walls 26C and the second sub outer walls 26D and crossing the fitting direction X, and indented inward of the fitting convex 24A is formed in the inner wall portion 16 of the fitting concave 14. Further, a pair of guiding grooves 28 extended in the fitting direction X is formed on the pair of first sub outer walls 26C in the outer wall portion 26, and the projections 18 of the male connector 1 are inserted into these guiding grooves 28.

The spacer 23 includes: a spacer main body 23A; and a not-shown insertion portion extended from the spacer main body 23A and inserted into the spacer receiving chamber of the housing main body 24. The spacer main body 23A is provided with a first spacer outer wall 23B parallel to the first outer wall 26A of the fitting concave 24A, and a pair of second spacer outer walls 23C respectively parallel to the pair of second sub outer walls 26D. The insertion portion of the spacer is provided with a not-shown regulating portion positioned inside of the terminal receiving chamber and abuttable on the female terminal 21 in the regular locking position where the whole spacer 23 is received in the spacer receiving chamber. In this regular locking position, the first spacer outer wall 23B is arranged in the same plane as the first outer wall 26A or sunken in the first outer wall 26A, and the second spacer wall 23C is arranged in the same plane as the second sub outer wall 26D or sunken in the second sub outer wall 26D. In contrast, in the temporary locking position shown in FIG. 2, the regulating portion of the spacer 23 is not abutted on the female terminal 21, the first spacer outer wall 23B is projected in the second crossing direction Z from the first outer wall 26A, and the second spacer wall 23C is projected in the second crossing direction Z from the second sub outer wall 26D.

The locking portion 25 includes: a protection portion 25A projected from the third outer wall 26E and formed in a gate shape; and a locking arm 25B disposed inside of the protection portion 25A, extended vertically from the third outer wall 26E, and more extended forward than the front wall 22A. An engaging concave 25C for receiving and engaging with the engaging projection 15B of the engaging portion 15 is provided on a tip of the locking arm 25B. Namely, when the male and female connectors 1, 2 are fitted to each other, firstly, the tip of the locking arm 25B is slotted into a lower side of the beam 15A of the engaging portion 15. Secondly, while the beam 15A and the locking arm 25B are elastically deformed, the engaging projection 15B and the engaging concave 25C are engaged with each other. Thereby, the fitting between the male and female connectors 1, 2 is locked. In contrast, when the locking arm 25B is elastically deformed by pushing, and the engagement between the engaging concave 25C and the engaging projection 15B is released, the lock is canceled and the male and female connectors 1, 2 are pulled off from each other.

A fitting procedure between the male and female connectors 1, 2 is, firstly, a plurality of male terminals 11 is received in the connector housing 12, and the male connector 1 is assembled. Further, a plurality of female terminals 21 is received in the connector housing 22, the spacer 23 is inserted into the spacer receiving chamber to the regular locking position, and the female connector 2 is assembled. Then, the fitting concave 14 of the male connector 1 and the front wall 22A of the connector housing 22 of the female connector 2 are opposite to each other, and moved close to each other in the fitting direction X to insert the fitting convex 24A into the fitting concave 14. At this time, the inner wall portion 16 of the fitting concave 14 and the outer wall portion 26 of the fitting convex 24A are slidably abutted on each other, or moved close to each other with a slight gap.

Figure 3:
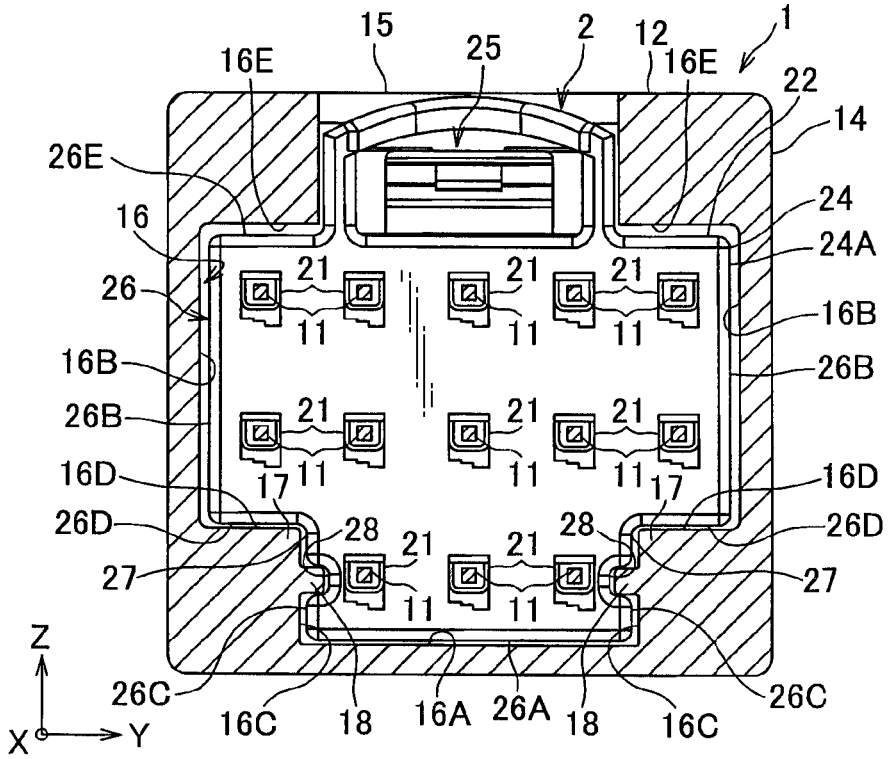
FIG. 3 is an explanatory view showing a fitting condition of the first and second connectors.

Concretely, as shown in FIG. 3, the first outer wall 26A follows the first inner wall 16A, the second outer wall 26B follows the second inner wall 16B, the first sub outer wall 26C follows the first sub inner wall 16C, the second sub outer wall 26D follows the second sub inner wall 16D, and the third outer wall 26E follows the third inner wall 16E, thereby the fitting convex 24A is inserted into the fitting concave 14. Namely, the second step portion 27 of the fitting convex 24A is moved close to and opposite to the first step portion 17 of the fitting concave 14, and moved relatively in the fitting direction X. Further, when the projection 18 of the fitting concave 14 is inserted into the guiding groove 28 of the fitting convex 24A, the relative displacement between the fitting concave 14 and the fitting convex 24A in the second crossing direction Z is prevented.

Thus, the walls of the fitting concave 14 and the walls of the housing main body 24 are moved close to each other and opposite to each other. Therefore, in a condition that the movement and the rotation are prevented other than the movement in the fitting direction X, the male and female connectors 1, 2 are further pressed so that the fitting convex 24A is deeply inserted into the fitting concave 14. Thereby, the plurality of male terminals 11 of the male connector 1 is respectively inserted into the corresponding female terminals 21 of the female connector 2, and the engaging portion 15 and the locking portion 25 are engaged with each other, so that the male and female connectors 1, 2 are locked together in the fitting condition. As described above, when the spacer 23 of the female connector 2 is inserted to the regular locking position, and the spacer 23 is not projected from the fitting convex 24A, the male and female connectors 1, 2 are smoothly fitted to each other.

Figure 4:
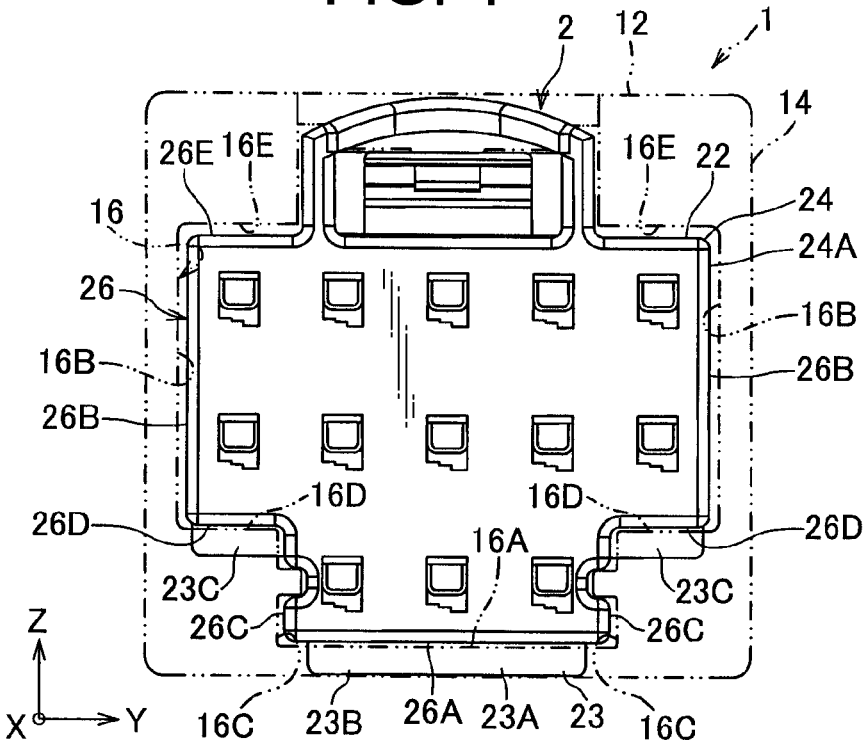
FIG. 4 is an explanatory view showing a non-fitting condition of the first and second connectors.
Figure 5:
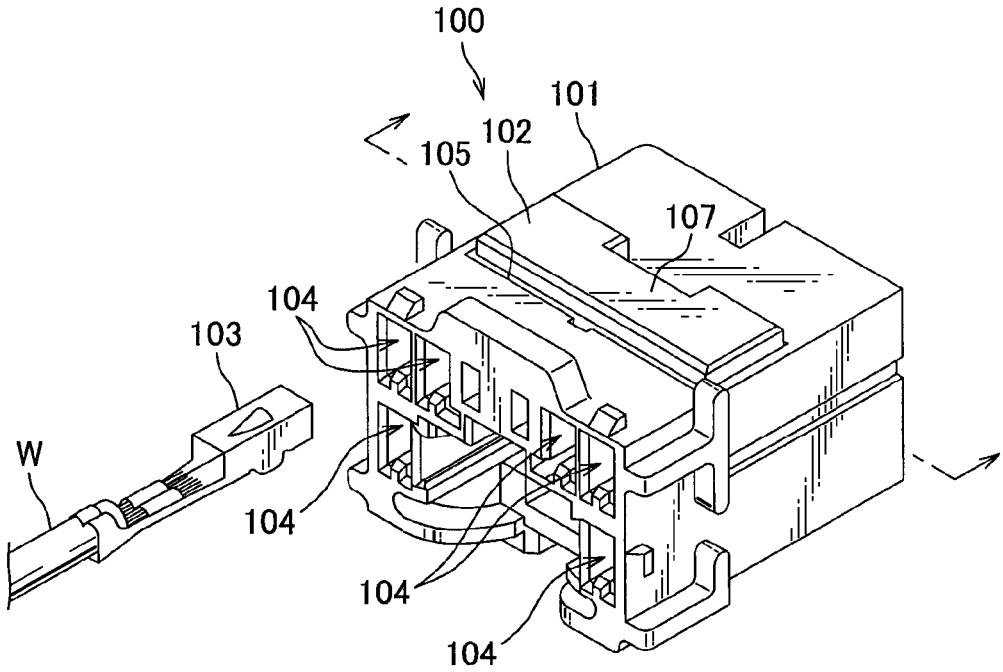
FIG. 5 PRIOR ART
FIG. 5 is a perspective view showing a conventional connector with a spacer.
Figure 6:
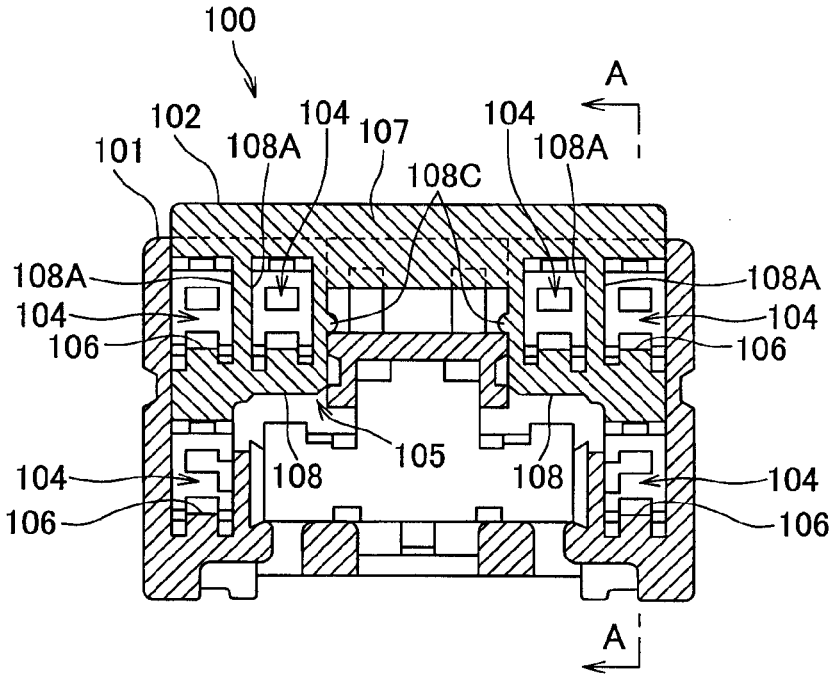
FIG. 6 PRIOR ART
FIG. 6 is a sectional view showing a temporary locking condition of the conventional connector.
Figure 7:
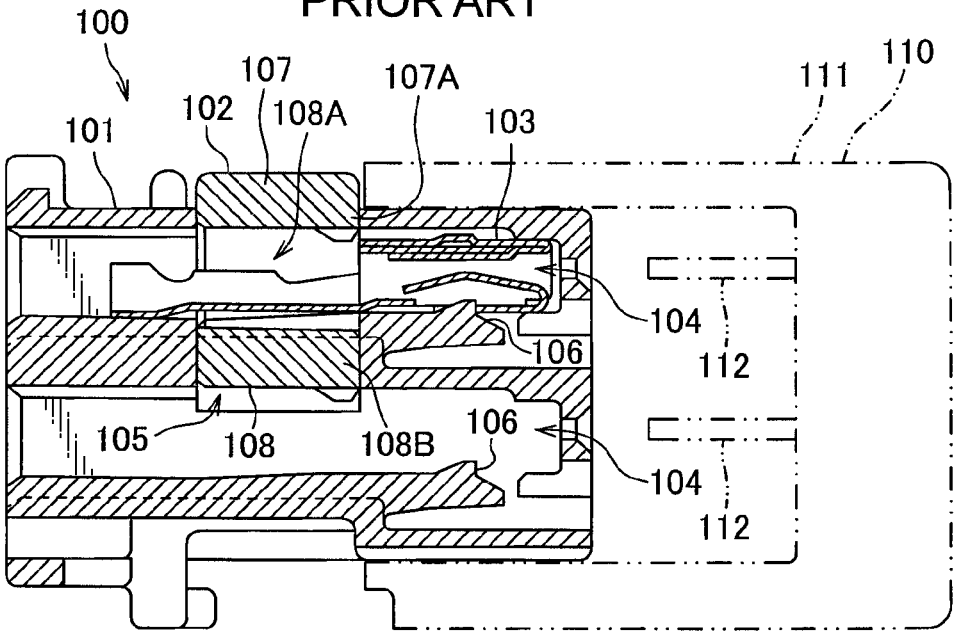
FIG. 7 PRIOR ART
FIG. 7 is a sectional view showing the conventional connector taken on line A-A of FIG. 6.
Figure 8:
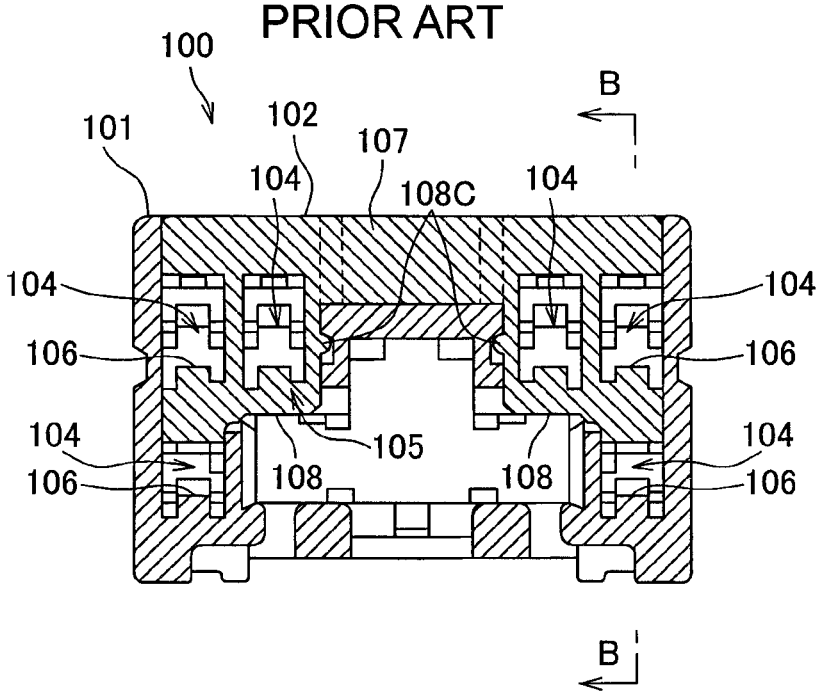
FIG. 8 PRIOR ART
FIG. 8 is a sectional view showing a regular locking condition of the conventional connector.
Figure 9:
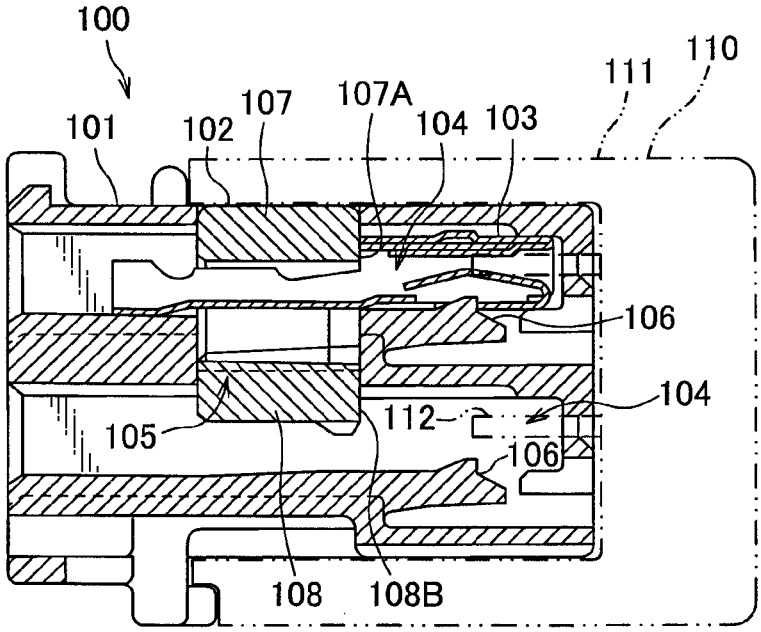
FIG. 9 PRIOR ART
FIG. 9 is a sectional view showing the conventional connector taken on line B-B of FIG. 8.

In contrast, as shown in FIG. 4, when the spacer 23 of the female connector 2 is not inserted to the regular kicking position, and in a condition that the first spacer outer wall 23B of the spacer 23 is projected from the first outer wall 26A, and the second spacer outer wall 23C is projected from the second sub outer wall 26D (middle insertion condition), the regulating portion of the spacer 23 is not abutted on the female terminal 21, and the female terminal 21 may fall out of the connector housing 22. In such a middle insertion condition of the spacer 23, when the male and female connectors 1, 2 are tried, to be fitted to each other, the projected first spacer outer wall 23B is abutted on around the first inner wall 16A of the fitting concave 14, and the second spacer outer wall 23C is abutted on around the second sub inner wall 16D, thereby the fitting convex 24A cannot be smoothly inserted and the middle insertion condition of the spacer 23 can be detected.

At this time, when the projection 18 is inserted into the guiding groove 28 and guided, a relative movement between the fitting concave 14 and the fitting convex 24A in the second crossing direction Z is prevented. Therefore, the first spacer outer wall 23B and the second spacer outer wall 23C projected in the second crossing direction Z becomes easy to be abutted on the fitting concave 14, and thereby the middle insertion condition of the spacer 23 is detected with high accuracy. Further, the second sub outer walls 26D from which the second spacer outer walls 23C are projected are provided left and right sandwiching the first outer wall 26A from which the first spacer outer wall 23B is projected, namely, the first step portions 17 of the fitting concave 14 and the second step portions of the fitting convex 24A are provided symmetrically left and right. Therefore, even when the fitting convex 24 is rotated or inclined upon insertion into the fitting concave 14, the middle insertion condition of the spacer 23 is easily detected.

According to this embodiment, while the spacer 23 is in the middle insertion condition, when the male and female connectors 1, 2 are tried to be fitted to each other, the first spacer outer wall 23B and the second spacer outer walls 23C projected from different positions of the fitting convex 24A are abutted on the fitting concave 14. Thereby, the middle insertion condition of the spacer 23 is detected with high accuracy. Namely, the first step portion 17 of the fitting concave 14 and the second step portion 27 of the fitting convex 24A are formed adjacent to and facing each other, and the second spacer outer wall 23C is projected from the second sub outer wall 26D of the second step portion 27, and the first spacer outer wall 23B is projected from the first outer wall. 26A shifted in the second crossing direction Z from the second sub outer wall 26D. Thereby, these become easy to be abutted on the fitting concave 14 and the detection accuracy of the middle insertion condition of the spacer 23 is improved. Therefore, while the spacer 23 is in the middle insertion condition, the male and female connectors 1, 2 are prevented from being fitted to each other, and the movement of the female terminal 21 is surely prevented by the spacer inserted to the regular locking position. Thereby, the female terminal 21 is prevented from falling out of the connector housing 22.

Incidentally, in this embodiment, the first connector is the male connector 1 having the male terminal 11, and the second connector is the female connector 2 having the female terminal 21. However, according to the present invention, the types of the terminals the first and second connectors have are not limited. Namely, the first connector may have the female terminal, and the second connector may have the male terminal. The type of the terminal each connector has can be properly selected.

Further, in this embodiment, the spacer 23 is provided on the female connector 2. However, the spacer may be provided on the male connector 1. In this case, when the spacer provided on the male connector 1 is in the temporary locking position, this spacer is configured to be projected inside of the fitting concave 14. Thereby, when the projected spacer is abutted on the fitting convex 24A of the female connector 2, the middle insertion condition of the spacer can be detected.

Further, in this embodiment, the male and female connectors 1, 2 are respectively provided with thirteen male terminals 11 and thirteen female terminals 21. However, according to the present invention, the number and the arrangement of the terminals are not limited.

Further, in this embodiment, the fitting convex 24A of the female connector 2 is formed in a convex octagonal column shape in front view, and the fitting concave 14 of the male connector 1 is formed in a shape corresponding to the fitting convex 24A. However, according to the present invention, the shapes of the fitting concave and the fitting convex are not limited to this embodiment. Namely, the first step portion of the fitting concave and the second step portion of the fitting convex may be provided respectively on one positions, or on more than two positions.

Further, the first sub inner wall 16C and the second sub inner wall 16D composing the first step portion is not limited to be perpendicular to each other. Similarly, the first sub outer wall 26C and the second sub outer wall 26D composing the second step portion is not limited to be perpendicular to each other. Namely, the shapes, the positions, and the numbers of the first and second step portions are not limited to this embodiment, and can be properly changed within a scope to achieve the effect of the present invention.

INDUSTRIAL APPLICABILITY

The connector unit according to the present invention can be used as a connector as a component of a wiring harness routed in a vehicle or the like, or as a connector provided on an electronic device and connected to the wiring harness or the like.

REFERENCE SIGNS LIST

1 male connector (first connector)
2 female connector (second connector)
11 mate terminal (first terminal)
12 connector housing (first connector housing)
14 fitting concave
16 inner wall portion
16A first inner wall
16B second inner wall
16C first sub inner wall
16D second sub inner wall
17 first step portion
18 projection
21 female terminal (second terminal)
22 connector housing (second connector housing)
23 spacer
24A fitting convex
26 outer wall portion
26A first outer wall
26B second outer wall
26C first sub outer wall
26D second sub outer wall
27 second step portion
28 guiding groove

The invention claimed is:

1. A connector unit comprising:

a first connector having a first connector housing receiving a first terminal; and a second connector having a second connector housing receiving a second terminal, said first and second connectors being fitted to each other by facing each other and pressing in a fitting direction, wherein the second connector includes a spacer provided movably in between a temporary locking position where the second terminal is allowed to fall out of the second connector housing and a regular locking position where the second terminal is prevented from falling out of the second connector housing, wherein the first connector housing includes a fitting concave having an inner wall portion extended in the fitting direction and formed in substantially a circular shape, and the inner wall portion has a first step portion extended perpendicular to the fitting direction and projected inward of the fitting concave, wherein the second connector housing includes a fitting convex having an outer wall portion extended in the fitting direction and formed in substantially a columnar shape, and the outer wall portion has a second step portion indented inward of the fitting convex, the second step portion corresponding to the first step portion, and wherein the spacer is projected from at least two positions of a part of the outer wall portion and the second step portion of the fitting convex in the temporary locking position, and is sunken in the outer wall portion or arranged in the same plane as the outer wall portion in the regular locking position, and wherein one of the first step portion of the fitting concave and the second step portion of the fitting convex is provided with a guiding groove extended in the fitting direction, and the other is provided with a projection to be inserted into the guiding groove.

2. The connector unit as claimed in claim 1, wherein the inner wall portion of the fitting concave includes:

a first inner wall along a first crossing direction of the first and a second crossing directions perpendicular to the fitting direction and crossing to each other;

a second inner wall along the second crossing direction;

a first sub inner wall crossing to the first inner wall and extended to an inside of the fitting concave; and a second sub inner wall crossing the second inner wall, extended to the inside of the fitting concave and continued to the first sub inner wall, and the first and second sub inner walls compose the first step portion, wherein the outer wall portion of the fitting convex includes:

while fitted to the fitting concave, a first outer wall adjacent and facing to the first inner wall;

a second outer wall adjacent and facing to the second inner wall; a first sub outer wall adjacent and facing to the first sub inner wall;

and a second sub outer wall adjacent and facing to the second sub inner wall, and the first and second sub outer walls compose the second step portion, and wherein the spacer in the temporary locking position is provided projectably from the first outer wall and the second sub outer wall.

3. The connector unit as claimed in claim 2, wherein in the inner wall portion of the fitting concave, a pair of the second inner walls facing to each other is provided, a pair of the first sub inner walls continued to both ends of the first inner wall is provided, a pair of the second sub inner walls extended to the pair of the first sub inner walls and the pair of second inner walls is provided, and in the outer wall portion of the fitting convex, a pair of the second outer walls respectively corresponding to the pair of the second inner walls is provided, a pair of the first sub outer walls respectively corresponding to the pair of the first sub inner walls is provided, and a pair of the second sub outer walls respectively corresponding to the pair of the second sub inner walls is provided.

* * * * *